US010730076B2

(12) United States Patent
Pedrini et al.

(10) Patent No.: US 10,730,076 B2
(45) Date of Patent: Aug. 4, 2020

(54) INTERCHANGEABLE BACKWIRE/COMBINED SIEVE AND DYNAMIC COMBINED CLEANER

(71) Applicant: Ocrim S.p.A., Cremona (IT)

(72) Inventors: Simone Pedrini, Cremona (IT); Fabrizio Ancona, Cremona (IT)

(73) Assignee: OCRIM S.P.A., Cremona (IT)

( * ) Notice: Subject to any disclaimer, the term of this patent is extended or adjusted under 35 U.S.C. 154(b) by 0 days.

(21) Appl. No.: 15/875,492

(22) Filed: Jan. 19, 2018

(65) Prior Publication Data

US 2019/0224722 A1 Jul. 25, 2019

(51) Int. Cl.

| | |
|---|---|
| ***B07B 1/54*** | (2006.01) |
| ***B07B 1/38*** | (2006.01) |
| ***B07B 1/46*** | (2006.01) |

(52) U.S. Cl.

CPC ..... *B07B 1/54* (2013.01); *B07B 1/38* (2013.01); *B07B 1/46* (2013.01); *B07B 1/4645* (2013.01); *B07B 1/4672* (2013.01)

(58) Field of Classification Search

CPC ..... B07B 1/4645; B07B 1/4672; B07B 1/54
USPC ..... 209/382
See application file for complete search history.

(56) References Cited

U.S. PATENT DOCUMENTS 1,799,416 A * 4/1931 Gillespie ..... B07B 1/54 209/387
2,332,780 A * 10/1943 Cecka ..... B07B 1/54 209/323
2,455,383 A * 12/1948 Pickard ..... B07B 1/526 209/323
2,723,752 A * 11/1955 Conkling ..... B07B 1/54 209/323
3,960,731 A * 6/1976 Brandt ..... B07B 1/54 210/332
4,929,346 A 5/1990 Yu
5,165,550 A 11/1992 Pierson
5,538,139 A * 7/1996 Keller ..... B07B 1/38 209/382
6,095,339 A * 8/2000 Filip ..... B07B 1/54 209/379
6,336,557 B1 * 1/2002 Ruter ..... B07B 1/522 209/385

(Continued)

FOREIGN PATENT DOCUMENTS

DE 370633 C 3/1923
DE 8713767 U1 12/1987
EP 0706836 A1 4/1996

(Continued)

OTHER PUBLICATIONS

International Search Report and Written Opinion of International Patent Application No. PCT/IB2019/050442, dated Sep. 26, 2019 (20 pages).

*Primary Examiner* — Terrell H Matthews
(74) *Attorney, Agent, or Firm* — Nixon Peabody LLP

(57) ABSTRACT

A sieve is disclosed for use in a plansifter. The sieve can be changed between backwire and combined sieve configurations without the height of the sieve changing, and while maintaining contact between a frame of the sieve and the sieve box. A dynamic combined cleaner also is disclosed in which the center of gravity of the cleaner dynamically changes based on inertial movements applied to the cleaner.

15 Claims, 15 Drawing Sheets

(56) References Cited

U.S. PATENT DOCUMENTS

| | | | | |
|---|---|---|---|---|
| 2007/0108107 | A1 | 5/2007 | Morrow | |
| 2017/0333950 | A1 * | 11/2017 | Kunzle | B07B 1/522 |

FOREIGN PATENT DOCUMENTS

| | | | | |
|---|---|---|---|---|
| EP | 2465616 | A1 * | 6/2012 | B07B 1/54 |
| FR | 332584 | A | 10/1903 | |
| FR | 1187206 | A | 9/1959 | |
| WO | WO 2006/040517 | A1 | 4/2006 | |
| WO | WO 2014/019925 | A1 | 2/2014 | |

* cited by examiner

INTERCHANGEABLE BACKWIRE/COMBINED SIEVE AND DYNAMIC COMBINED CLEANER

FIELD OF THE PRESENT DISCLOSURE

The present disclosure relates generally to plansifters and, more particularly, to sieves and cleaners used within plansifters.

BACKGROUND

Plansifters are used for the separation and grading of cereals and all products resulting from their breaking and milling. Plansifters generally are formed of channels joined to and driven by a central body containing a rotating counterweight. Plansifters are suspended by means of rods or other elastic devices so they can freely move within a circular or elliptical-like path. Separation within each plansifter is managed by designing a sieve stack, which is a stack composed of multiple sieves. Depending on, for example, the granularity of the grading or other factors, a stack can have various numbers of sieves. While there is no limit to the number of sieves in a stack, some models of sifters can have less than 10 sieves, and other models of sifters can have 30 or more sieves. However, commonly, sifters have less than 30 sieves, such as about 24 to 27 sieves.

Each sieve includes a sieve cloth attached (e.g., glued, stapled, etc.) onto a removable frame that sits within a sieve box. The sieve cloth receives the material to be sieved from the top and, aided by mechanical movement of the stack, allows particles smaller than the mesh opening of the sieve cloth (generally from 112 μm to 5000 μm) to fall into a sieve box below the sieve cloth. Particles larger than the mesh opening continue to move on the sieve cloth until reaching a dedicated falling zone in the sieve box. The removable frame includes dividers that separate the sieve cloth "cleaning zones." Typically, there are about six to nine cleaning zones for each sieve. The sieve box serves as the outer boundary of the sieve and redirects the product falling from the cloth onto sieves below. Depending on the type of sieve, explained in greater detail below, each sieve also includes multiple cleaners/expellers (typically one per cleaning zone) that freely move based on the mechanical movement of the stack and aid the movement of the particles through the mesh openings within the sieve cloth or to the falling zone. There currently are two types of sieves: backwire sieves and combined sieves, which are described below in relation to FIGS. 1 and 2.

FIG. 1 illustrates a backwire sieve 100. The backwire sieve 100 includes the sieve box 102. The sieve box 102 includes a sieving zone 102*a* and a falling zone 102*b*. The sieving zone 102*a* includes a sieve cloth (not shown) that provides the sieving action. The sieve cloth allows particles of a certain size or smaller to fall through. Once the particles fall through the sieve cloth, they are expelled out of the sieve box 102 through side openings 102*c* and fall down a channel to either another sieve with the sieve stack or a collection point. The side openings 102*c* can be on one side of the sieve box 102 or can be on two or three sides of the sieve box 102, depending on the desired configuration. The larger particles that remain on the sieve cloth reach the falling zone 102*b* caused by the mechanical movement of the sieve 100. At the falling zone 102*b*, the larger particles fall through a separate channel to either another sieve below within the sieve stack or a collection point.

The backwire sieve 100 also includes the removable frame 104 that sits on the sieve box 102, a backwire grille 106 that sits within the sieve box 102 below the frame 104, and a bottom sheet 108 that sits within the sieve box 102 and below the backwire grille 106 when installed into a plansifter. The backwire grille 106 can be fastened to the frame 104 or lie loose between frame 104 and the sieve box 102. The sieve box 102 and the frame 104 can include dividers 110*a* and 110*b* that divide the sieve 100 into multiple, separate expulsion zones 112*a* (e.g., dividers 110*a*) and cleaning zones 112*b* (e.g., dividers 110*b*). Specifically, the dividers 110*a* on the sieve box 102 divide the sieving zone 102*a* into multiple different expulsion zones 112*a*. In some embodiments, there can be the same number of expulsion zones 112*a* as side openings 102*c*, such that each expulsion zone 112*a* corresponds to a separate side opening 102*c*. The dividers 110*b* on the frame 104 divide the sieving zone 102*a* into multiple different cleaning zones 112*b*, above the expulsion zones 112*a*. The combination of an expulsion zone 112*a* and a cleaning zone 112*b* spans from the bottom sheet 108 to the sieve cloth (not shown) attached to the top of the frame 104.

Within each cleaning zone 112*b* above the backwire grille 106 and below the sieve cloth is an untethered cleaner (not shown). During operation of the sieve 100, the cleaner has an erratic bouncing movement so that it continuously taps the sieve cloth above and avoids the product from choking the mesh openings in the sieve cloth. The distance between the sieve cloth and the backwire grille 106, therefore, should be a set distance so that that cleaner can contact the sieve cloth.

Within each expulsion zone 112*a* below the backwire grille 106 is an expeller (not shown). The expeller pushes the particles that fall through the sieve cloth to the side openings 102*c* of the sieve box 102. Because the expeller does not need to contact the backwire grille 106, there is no distance requirement between the bottom sheet 108 and the backwire grille 106.

FIG. 2 illustrates a combined sieve 200. The combined sieve 200 is substantially similar to the backwire sieve 100, except that the combined sieve 200 lacks the backwire grille 106. Thus, elements of the combined sieve 200 that are similar to the elements described above for the backwire sieve 100 are similarly numbered. The word "combined" in the term "combined sieve" connotes that one device is present that carries out both the cleaning and ejecting or expelling functions of the two devices referred to as a cleaner and an expeller described above.

The combined sieve 200 includes the sieve box 202 with the sieving zone 202*a* and the falling zone 202*b*. The sieve box 202 further includes side openings 202*c* that allow particles that fall by gravity through the sieve cloth (not shown) to escape the sides of the sieve box 202. The side openings 202*c* can be on one side of the sieve box 202 or can be on two or three sides of the sieve box 202, depending on the desired configuration. The falling zone 202*b* allows the particles too large to fall through the sieve cloth to instead move to the side of the sieve 200 and fall to a sieve below.

The combined sieve 200 also includes the removable frame 204 that sits on the sieve box 202 and a bottom sheet 208 that sits within the sieve box 202 and below the sieve cloth. The sieve box 202 and the frame 204 can include dividers 210*a* and 210*b* that divide the sieve box 202 and the frame 204 into separate expulsion zones 212*a* and cleaning zones 212*b*, respectively. Thus, like the expulsion zones 112*a* and cleaning zones 112*b* above, the combination of an expulsion zone 212*a* and a cleaning zone 212*b* spans from the bottom sheet 208 to the sieve cloth (not shown) attached to the top of the frame 204.

Because the combined sieve 200 lacks a backwire grille, within each cleaning zone 212*b* can be a combined cleaner 214 that performs both the cleaning and expelling described above. As the combined sieve 200 moves, the combined cleaner 214 moves around and bounces about the cleaning zone 212*b* erratically, tapping the sieve cloth above and pushing fine particles out of the sieve box 202 through the side openings 202*c*. The distance between the sieve cloth and the bottom sheet 208 should be a fixed distance so that that combined cleaner 214 can contact the sieve cloth with enough force to clean the sieve cloth.

With the above configurations of the backwire sieve 100 and combined sieve 200 in mind, one of the main constraints of plansifters is stack height. Stack height is important because, during the work phase, the stack is compressed between covers so that the product placed between a sieve and the underneath cannot escape from the stack. If the stack height is less than a certain value, compressive sealing is not guaranteed. If stack height is more than a certain value, there are problems inserting the complete stack into a channel. Further, there must be enough volume for the incoming product to avoid choking and clumping. This problem also becomes more of a concern as the fine percentage rises and increases the sieve cloth throughput occupying the finite underlying volume. The lesser sieve height, the lesser the volume underneath the sieve and/or available to throughput. For this reason, channels using combined sieves generally contain 1 or 2 sieves more than channels using backwire sieves, considering the same product flow rate.

There are situations where backwire sieves or combined sieves can be employed, and situations where one may be considered better than the other. However, because of the simplicity in managing sifting stack schemes, maintenance of sieves, spare parts, and the like, there are no stacks comprising both backwire sieves and combined sieves. Also, because of different distances from the bottom sheet to the sieve cloth between backwire and combined sieves, it is not possible to switch from one style to the other, such as by removing the backwire grille.

Further, drawbacks exist for the combined cleaner of combined sieves as compared to the separate cleaners and expellers in backwire sieves. For example, the uneven surface of the backwire grille provides for more erratic movement of the cleaners in backwire sieves as compared to the even bottom sheet with combined cleaners in combined sieves. Further, despite the erratic movement of combined cleaners caused by the mechanical movement of the sieve stack, the combined cleaners still move over preferential paths that results in better cleaning in certain areas versus others.

Accordingly, aspects of the present disclosure solve the above issues associated with the incompatibility between backwire and combined sieves by providing a single sieve that can be switched between backwire and combined configurations. Further, aspects of the present disclosure solve the above issues associated with combined cleaners by providing a dynamic center of gravity.

SUMMARY

An aspect of the present disclosure includes a sieve for a plansifter that is interchangeable between a backwire configuration and a combined configuration. The height of the sieve does not change between being configured as a backwire sieve and a combined sieve. Further, the frame of the sieve maintains the same contact with the sieve box of the sieve with the sieve in the backwire or combined configuration.

Additional aspects of the present disclosure include a sieve for a plansifter configured to be interchangeable between a backwire configuration and a combined configuration. The sieve includes a sieve box having an open top. The sieve box is divided into a sieving zone and a falling zone. The sieve box also includes at least one aperture through at least one side wall within the sieving zone and at least one ledge along an interior of at least one wall within the sieving zone. The sieve further includes a removable frame configured to fit within the sieving zone of the sieve box. The frame has an overhang portion configured to sit on an edge of the sieve box around the sieving zone and an extended portion configured to sit on the at least one ledge. The extended portion defines a notch at a bottom of the frame that is configured to accept a backwire grille between the at least one ledge and the frame, with the sieve configured as the backwire sieve, without changing an overall height of the sieve or reducing the net sieving surface in a sieve box.

Further aspects of the present disclosure include a dynamic combined cleaner for a sieve within a sieve stack of a plansifter. The combined cleaner refers to a single apparatus that performs the combined functions of both cleaning and ejecting or expelling. The cleaner includes a body having a first side configured to face a sieve cloth of the sieve and a second side configured to face a bottom sheet of the sieve. The cleaner further includes a projection extending from the second side of the body and being configured to rest on the bottom sheet of the sieve. The cleaner further includes a plurality of cleaning heads extending from the first side of the body and being configured to contact the sieve cloth during use of the dynamic combined cleaner. The cleaner further includes one or more weight elements housed within the body and configured to dynamically change a center of gravity of the dynamic combined cleaner during use within the sieve. In these aspects, the combined cleaner can be said to possess both static (inertial) unbalancing and dynamic (kinetic) unbalancing features, which in concert provide a more efficacious cleaning and cleaning surface area coverage compared to conventional cleaners or expellers.

Further aspects of the present disclosure include a combined cleaner for a sieve within a sieve stack of a plansifter. The cleaner includes a body, a projection protruding from a side of the body, and multiple cleaning heads extending from the other side of the body. The cleaner further includes one or more discrete weight elements in or on the body. The one or more discrete weight elements and the projection provide an unbalancing to the cleaner such that under static conditions the cleaner is unbalanced while at rest on the projection Additional aspects of the present disclosure will be apparent to those of ordinary skill in the art in view of the detailed description of various embodiments, which is made with reference to the drawings, a brief description of which is provided below.

Figure 1:
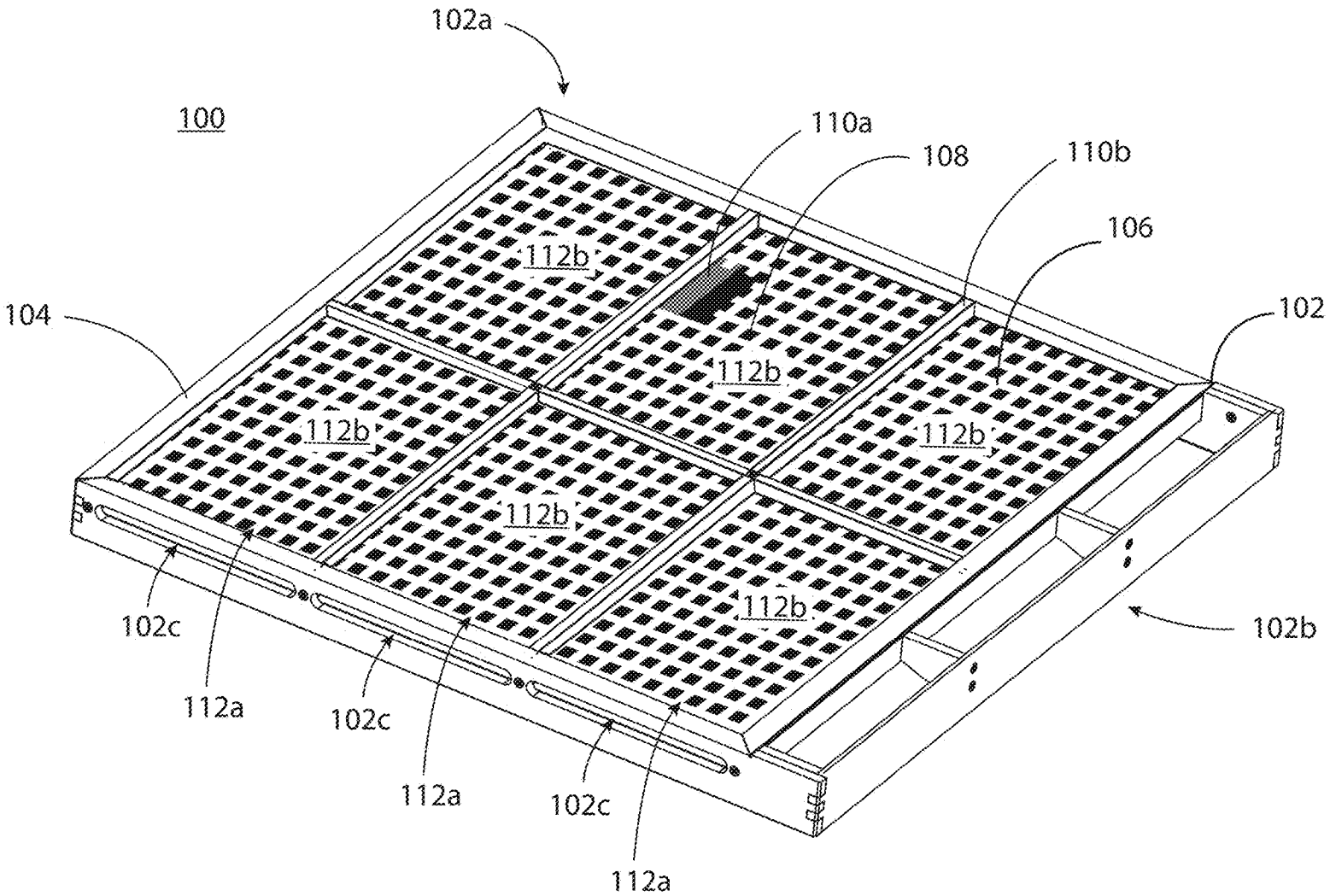
FIG. 1 illustrates a backwire sieve of the related art.

The present disclosure is susceptible to various modifications and alternative forms, and some representative embodiments have been shown by way of example in the drawings and will be described in detail herein. It should be understood, however, that the disclosure is not intended to be limited to the particular forms illustrated and described. Rather, the present application covers all modifications, equivalents, and alternatives falling within the spirit and scope of the present disclosure, as further defined by the appended claims.

DETAILED DESCRIPTION

While the concepts disclosed herein are susceptible to embodiment in many different forms, there is shown in the drawings and will herein be described in detail example implementations of the concepts with the understanding that the present disclosure is to be considered as an exemplification of the principles of the concepts and is not intended to limit the broad aspects of the disclosed implementations to the examples illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

The present disclosure provides a sieve having a sieve box and a sieve frame that can be selectively configured for use in a backwire-sieve or a combined-sieve configuration, depending on which sieve type is appropriate. Further, the height of the sieve does not change between the sieve being configured as a backwire wire and as a combined sieve. Also, the contact of the frame with the sieve box remains the same for the backwire and combined configurations.

Figure 3A:
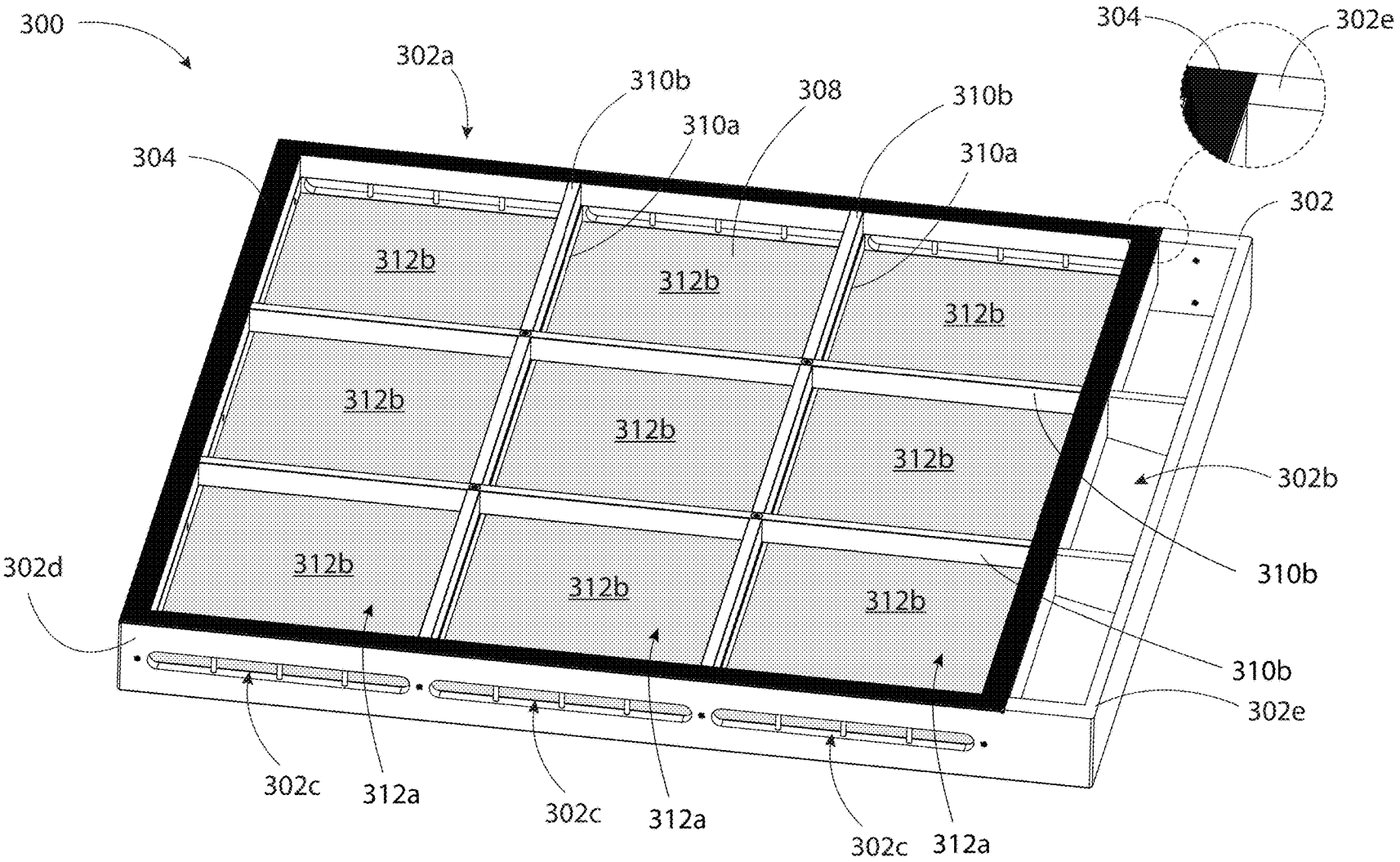
FIG. 3A illustrates a perspective view of a sieve that can be changed between a backwire configuration and a combined configuration, in accord with aspects of the present disclosure.
Figure 3B:
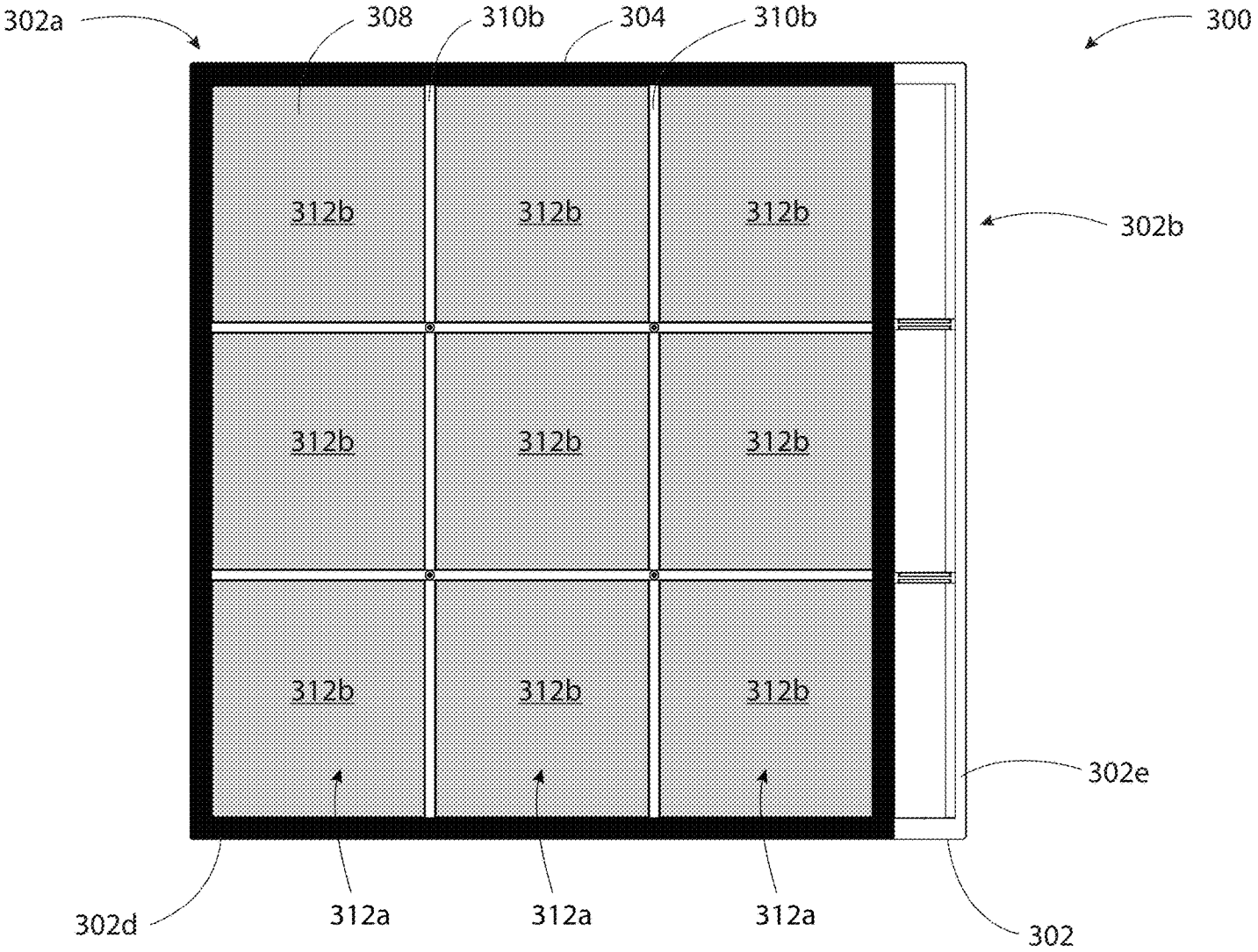
FIG. 3B illustrates a top view of the sieve of FIG. 3A, in accord with aspects of the present disclosure.
Figure 3C:
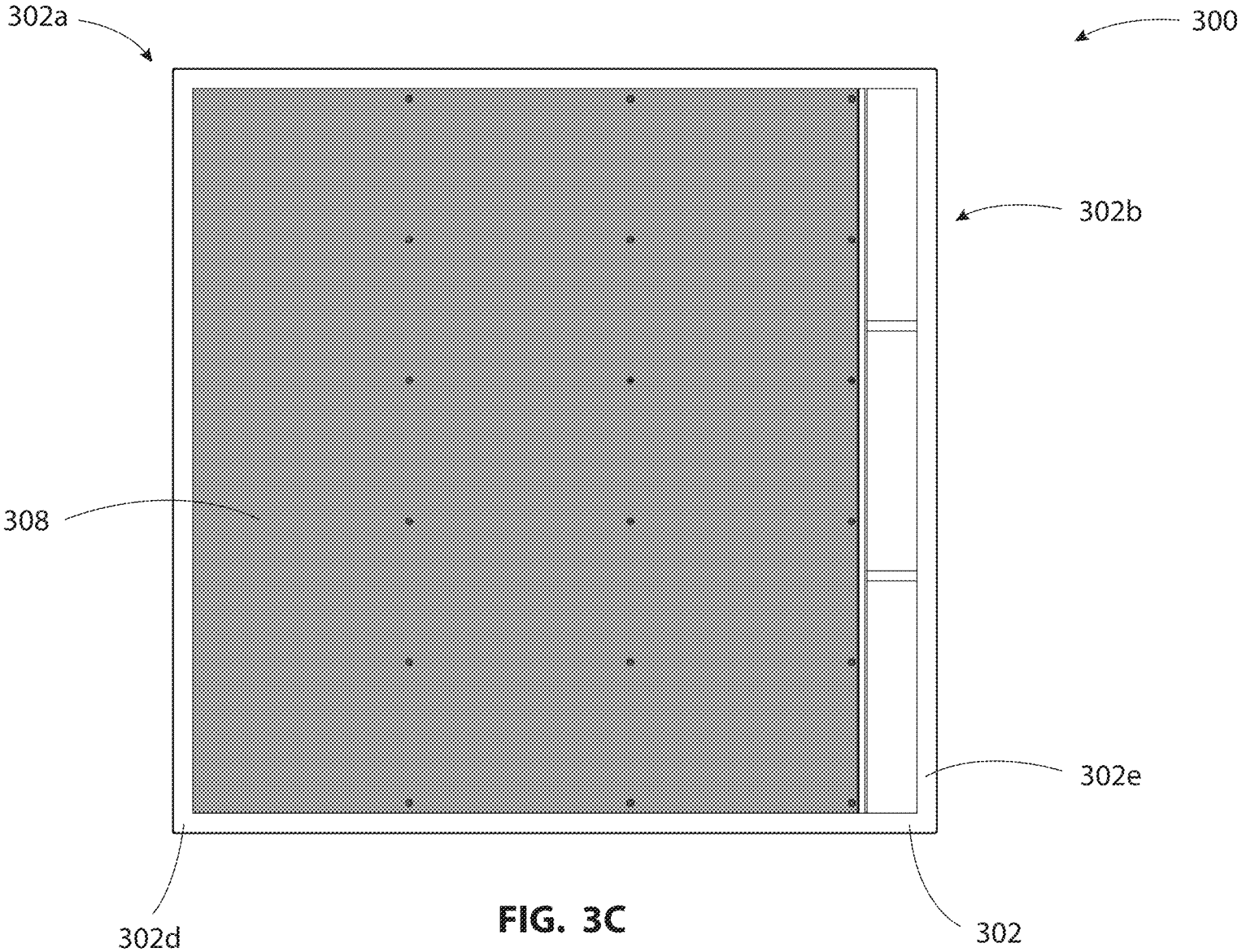
FIG. 3C illustrates a bottom view of the sieve of FIG. 3A, in accord with aspects of the present disclosure.
Figure 3D:
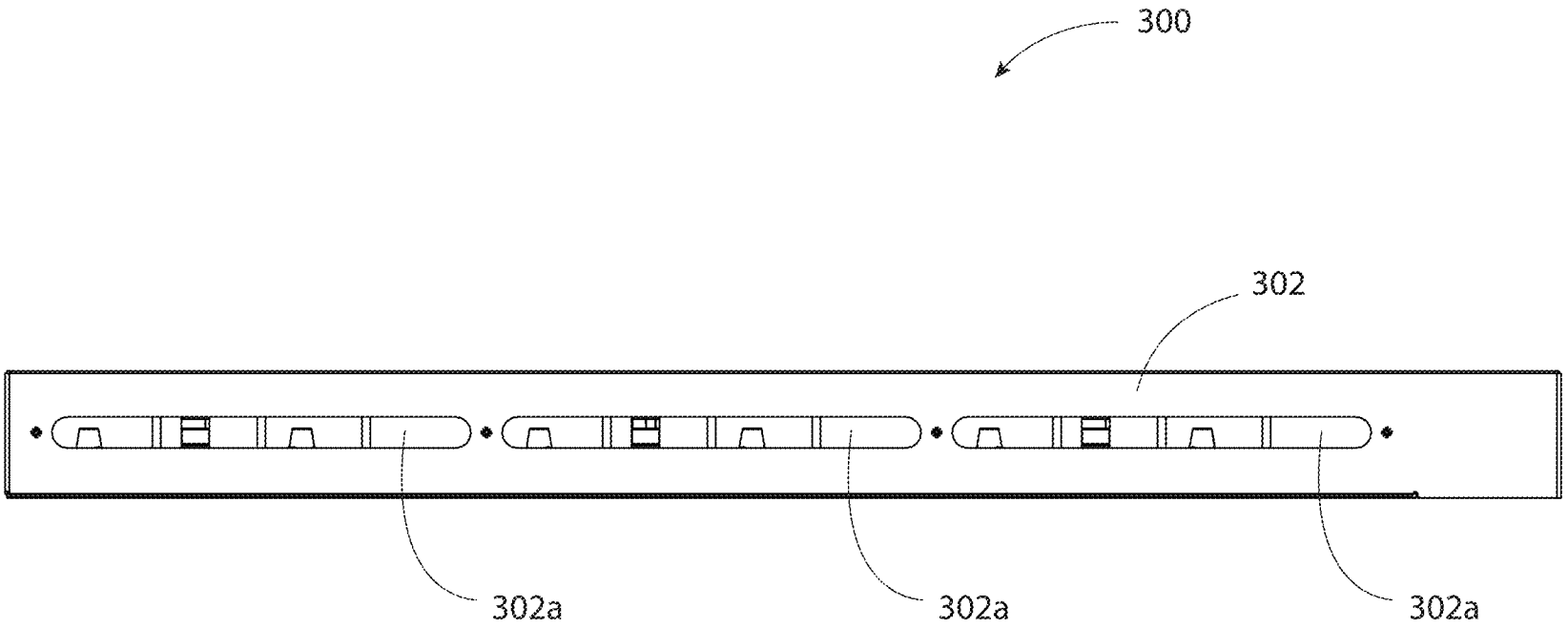
FIG. 3D illustrates a side view of the sieve of FIG. 3A, in accord with aspects of the present disclosure.
Figure 3E:
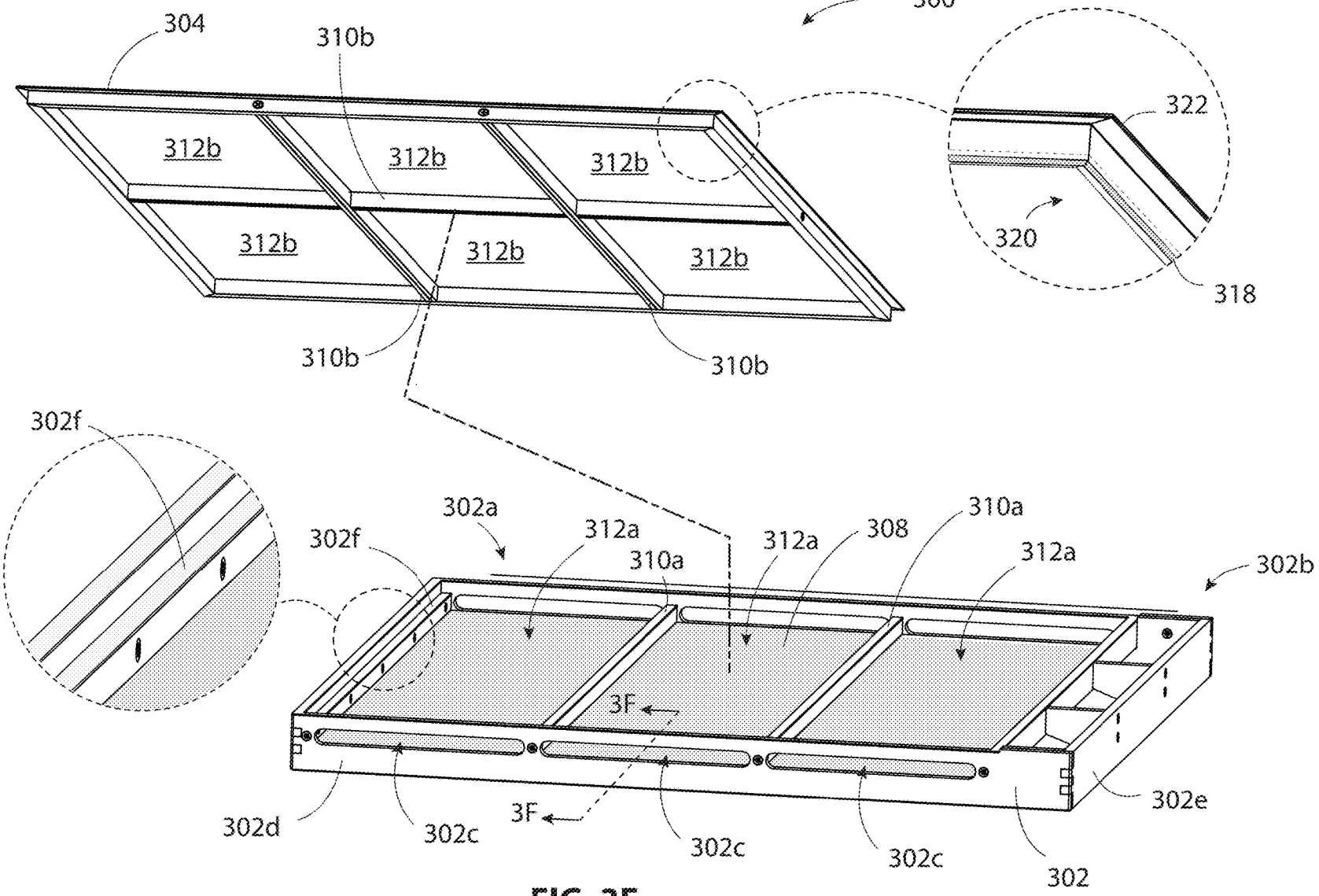
FIG. 3E illustrates an exploded view of the sieve of FIG. 3A, in accord with aspects of the present disclosure.
Figure 3F:
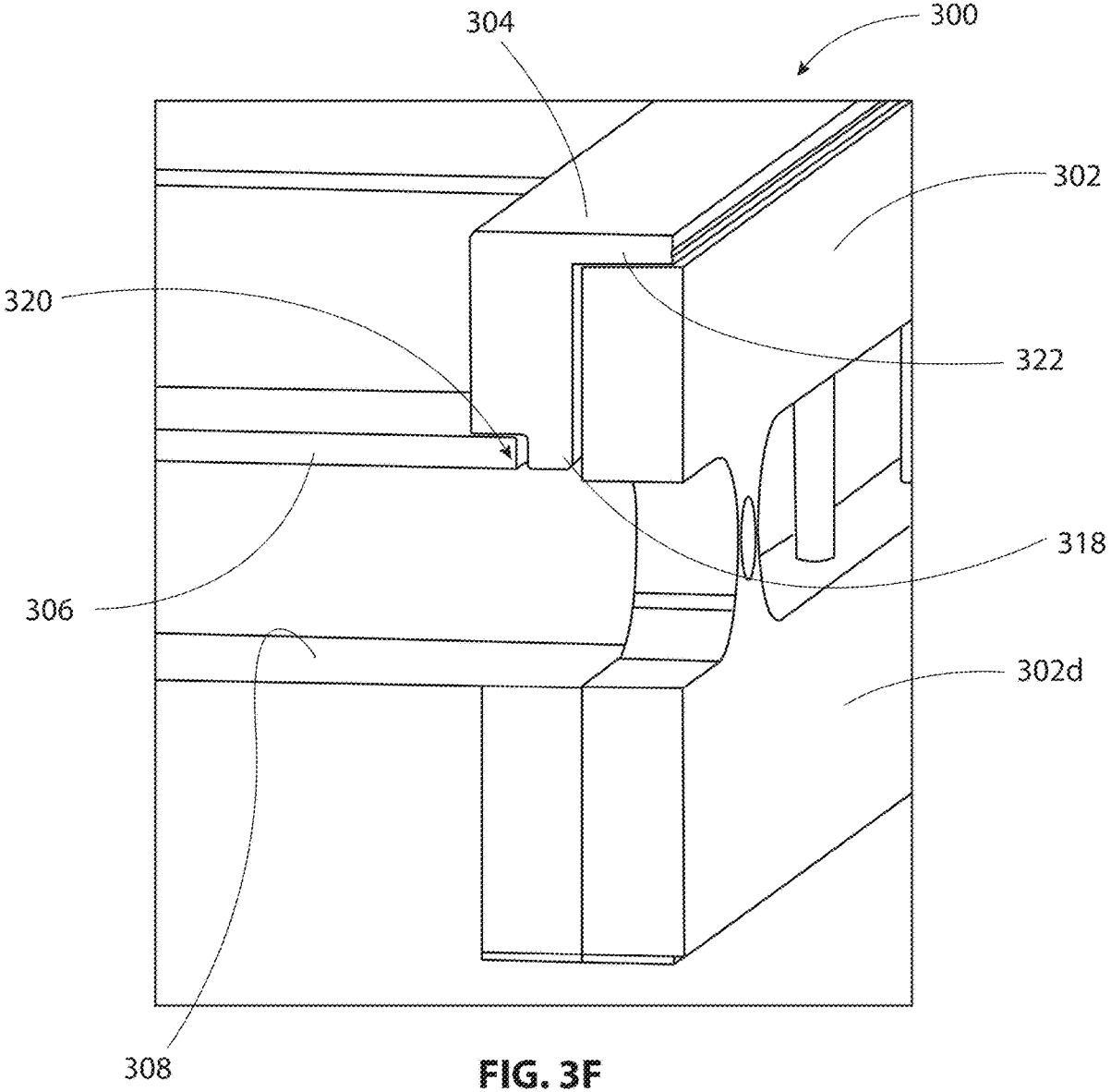
FIG. 3F illustrates a detailed cross-sectional view of the sieve of FIG. 3A along the line 3F-3F in FIG. 3E, in accord with aspects of the present disclosure.

FIGS. 3A-3F illustrate a sieve 300 that solves the above-addressed issues of conventional backwire and combined sieves. Specifically, FIG. 3A illustrates a perspective view of the sieve 300, in accord with aspects of the present disclosure. FIG. 3B illustrates a top view of the sieve of FIG. 3A, in accord with aspects of the present disclosure. FIG. 3C illustrates a bottom view of the sieve of FIG. 3A, in accord with aspects of the present disclosure. FIG. 3D illustrates a side view of the sieve of FIG. 3A, in accord with aspects of the present disclosure. FIG. 3E illustrates an exploded view of the sieve of FIG. 3A, including a bottom perspective view of the exploded-out frame, in accord with aspects of the present disclosure. FIG. 3F illustrates a detailed cross-sectional view of the sieve of FIG. 3A along the line 3F-3F in FIG. 3E, in accord with aspects of the present disclosure. As used herein, the terms bottom, top, and the like are in reference to views of a plansifter and its components or parts as installed relative to earth. Milled product is introduced at the top and falls through the plansifter under the force of gravity aided by the mechanical vibrational movements of the plansifter.

Referring to FIG. 3A, the sieve box 302 is generally divided into a sieving zone 302*a* and a falling zone 302*b*. Side walls 302*d* of the sieve box 302 at the sieving zone 302*a* are shorter than the end walls 302*e* of the falling zone to accommodate the thickness of the frame 304. That is, with the frame 304 on the sieve box 302, the top of the frame 304 is flush with the walls 302*e* of the falling zone 302*b* to present a flat surface of the sieve 300 for the sieve stack. Within two of the walls 302*d* are openings 302*c* that allow particles to pass through the sieve box 302 and onto to sieves below. However, the openings 302*c* can be in one or more of the walls 302*d*.

The sieve box 302 includes two ledges 302*f* (FIG. 3E) as shown on opposite ends of the sieve box 302. The ledges 302*f* support the frame 304 within the sieve box 302. As discussed above, the frame 304 includes the sieve cloth (not shown). The ledges 302*f* also support the backwire grille 306, when the sieve 300 is configured as a backwire sieve with the backwire grille 306 within the sieve box 302. The sieve box 302 also includes dividers 310*a*. The dividers 310*a* separate the sieving zone 302*a* of the sieve box 302 into the three expulsion zones 312*a*. The frame 304 also includes dividers 310*a* that separate the sieving zone 302*a* of the sieve box 302 into six cleaning zones 312*b*. Below the dividers 310*a* and 310*b* and the frame 304 within the sieving zone 302*a* is the bottom sheet 308 where the particles that fall through the sieve cloth collect prior to falling through the openings 302*c*.

Referring to FIG. 3F, the bottom of the frame 304 includes an extended portion 318 that provides a peripheral zone of support and sits on the ledge 302*f* of the sieve box 302. The extended portion 318 allows the frame 304 to sit on the ledge 302*f* so that the sieve box 302 supports the frame 304 with or without the backwire grille 306 within the sieve 300. The extended portion 318 also defines a notch 320. The notch 320 accommodates the backwire grille 306 with the sieve 300 configured as a backwire sieve. Thus, the extended portion 318 and the notch 320 allows the frame 304 to work in both backwire and combined configurations, with or without the backwire grille 306, and the notch 320 allows the frame 304 to accommodate a backwire grille 306 without changing the overall height of the sieve 300 with the backwire grille 306 present versus without. The constant height allows the same number of sieves 300 to be in a sieve stack regardless of their configuration, while still providing the ability to change the sieves 300 between backwire and combined configurations, as desired.

As also shown in FIG. 3F, the frame 304 includes the overhang portion 322 that sits on the top of the sieve box 302 around the sieving zone. The walls 302*e* of the falling zone 302*b* are flush with the top of the frame 304 based on the thickness of the overhang portion 322.

Figure 4A:
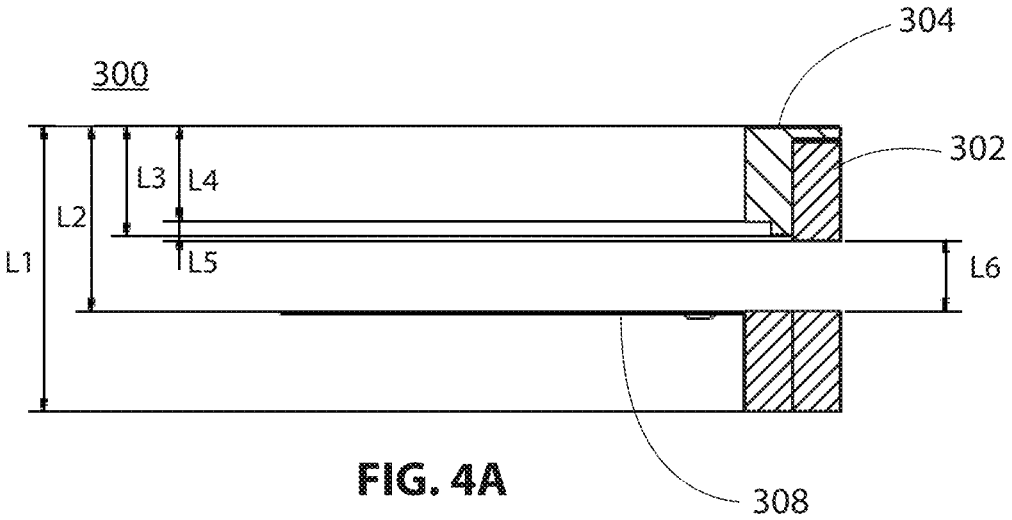
FIG. 4A illustrates a cross-sectional view of the sieve of FIGS. 3A-3F, with dimensions, in accord with aspects of the present disclosure.
Figure 4B:
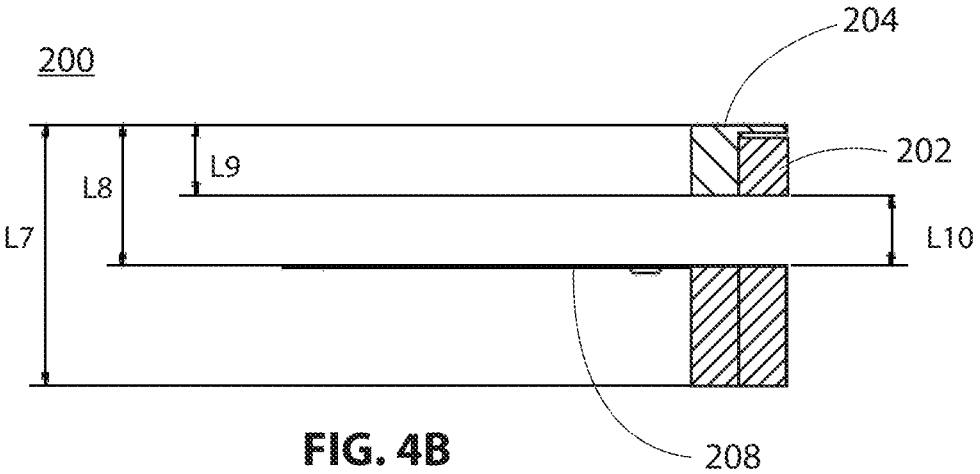
FIG. 4B illustrates a cross-sectional view of the sieve of FIG. 2, with dimensions, in accord with aspects of the present disclosure.
Figure 4C:
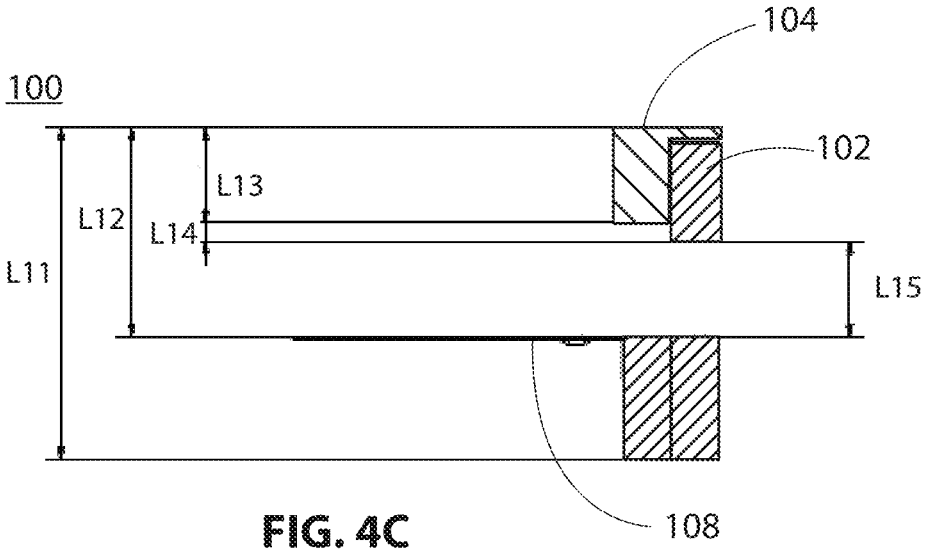
FIG. 4C illustrates a cross-sectional view of the sieve of FIG. 1, with dimensions, in accord with aspects of the present disclosure.

FIGS. 4A-4C illustrate cross-sectional views of the sieves 300, 200, and 100, respectively, through walls of the sieve boxes and the frames, along with various dimensional relationships. Referring to FIG. 4A, the length L1 of the sieve 300 is the height of the sieve 300 and can vary depending on the specific requirements of the sieve 300 within a plansifter. The length L2 is the distance from the bottom sheet 308 to the top of the sieve 300. In some embodiments, the length L2 can be about 55% to about 75% of the length L1, such as about 65% of the length L1. The length L3 is the height of the frame 304. In some embodiments, the length L3 can be about 50% to about 70% of the length L2, such as about 60% of the length L2. The length L4 is the distance from the top of the backwire grille 306 (when present) to the top of the sieve 300. In some embodiments, the length L4 can be about 40% to about 60% of the length L2, such as about 50% of the length L2. The length L5 is the distance the extended portion 318 extends outward. In some embodiments, the length L5 can be about 6% to about 10% of the length L2, such as 6% or 7% or 8% or 9% or 10% of the length L2. The length L6 is the height of the opening 302*c*. In some embodiments, the length L6 can be about 34% to about 44% of the length L2, such as about 34% or 35% or 36% or 37% or 38% or 39% or 40% or 41% or 42% or 43% or 44% of the length L2. In some embodiments, the ratio of the length L3 to the length L6 (e.g., L3/L6) can be about 1.5:1 (e.g., 1.4:1 or 1.6:1), and the ratio of the length L1 to the length L6 (e.g., L1/L6) can be about 4:1 (e.g., 3.9:1 or 4.1:1).

Referring to FIG. 4B, the length L7 of the sieve 200 is the height of the sieve 200. The length L8 is the distance from the bottom sheet 208 to the top of the sieve 200. The length L9 is the distance from the bottom of the frame 204 to the top of the sieve 200. The length L10 is the height of the opening 202*c*. As shown, the frame 204 does not include an extended portion.

Referring to FIG. 4C, the length L11 of the sieve 100 is the height of the sieve 100. The length L12 is the distance from the bottom sheet 108 to the top of the sieve 100. The length L13 is the distance from the bottom of the frame 104 to the top of the sieve 100. The length L14 is the thickness of the backwire grille 106. The length L15 is the height of the opening 102*c*.

According to the configuration described above for the sieve 300, the ratio L3/L6 of the height of the frame to the height of the side opening can be greater than the corresponding ratio of the sieves 200 and 100. Further, the ratio L1/L6 of the height of the sieve to the height of the side opening can be greater than the corresponding ratio of the sieves 200 and 100.

As discussed above, aspects of the present disclosure also include a dynamic combined cleaner that has a dynamic center of gravity. This allows the dynamic combined cleaner to provide better contact against a sieve cloth and also not follow preferential paths within a sieve during use. Better overall cleaning coverage of the cloth is provided using the dynamic combined cleaner according to the present disclosure, and the dynamic combined cleaner according to the present disclosure also doubles as an expeller, hence the term "combined" cleaner.

Figure 2:
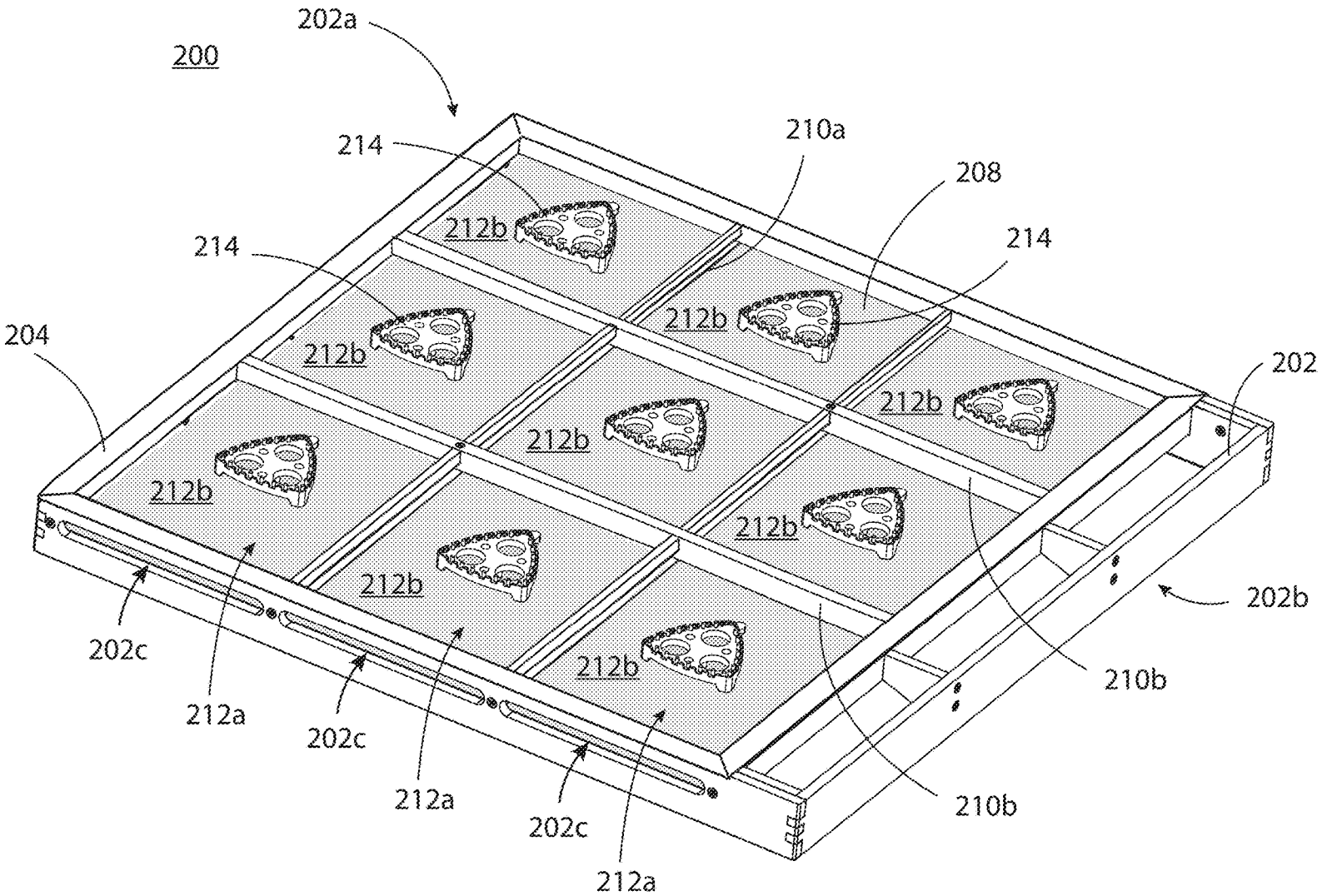
FIG. 2 illustrates a combined sieve of the related art.

Although the dynamic combined cleaner is disclosed below in the context of the sieve 300, the dynamic combined cleaner can be used in any type of combined sieve, including the combine sieve of the related art, such as shown in FIG. 2.

Figure 5A:
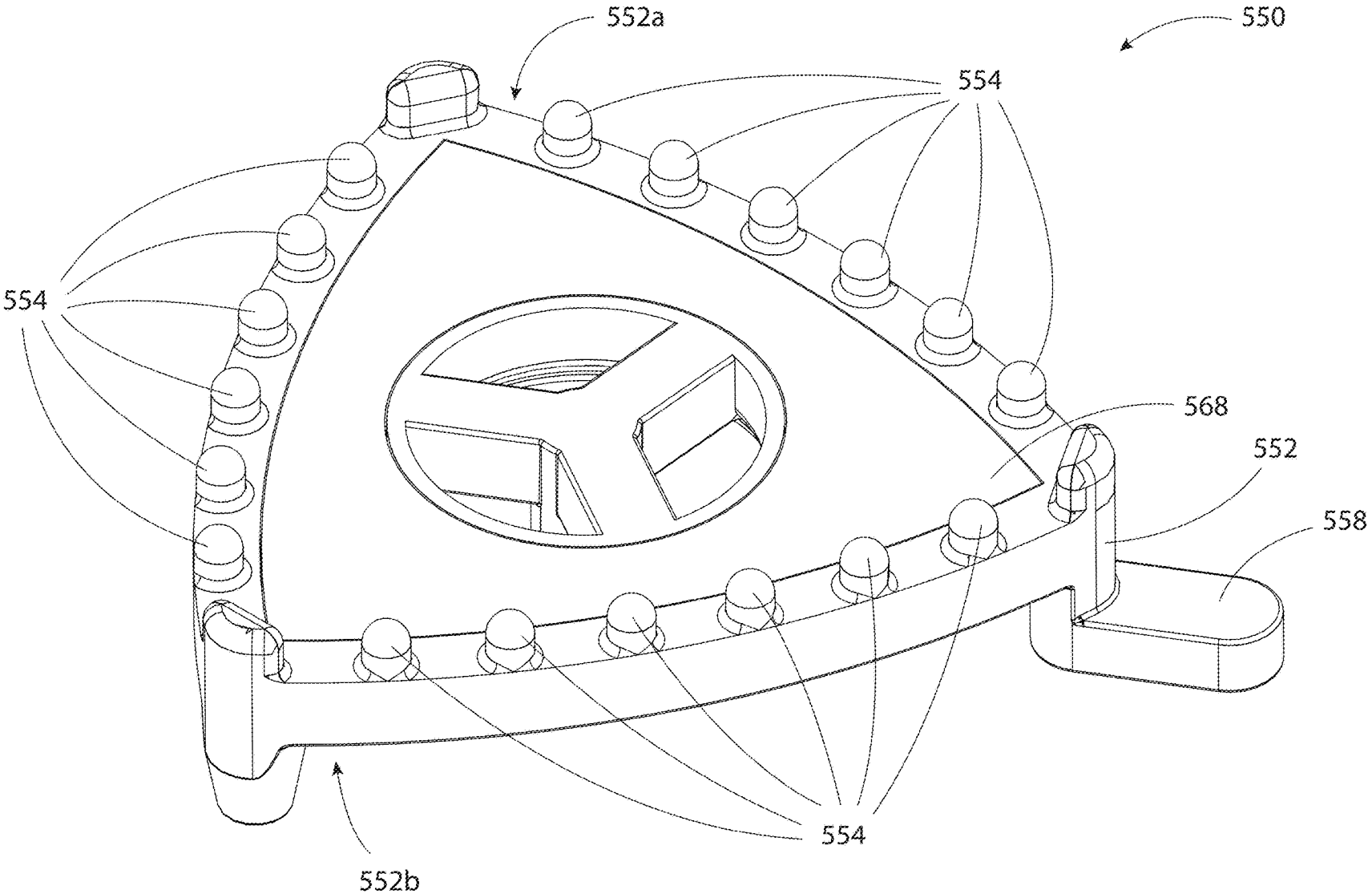
FIG. 5A illustrates a perspective view of a dynamic combined cleaner, in accord with aspects of the present disclosure.
Figure 5B:
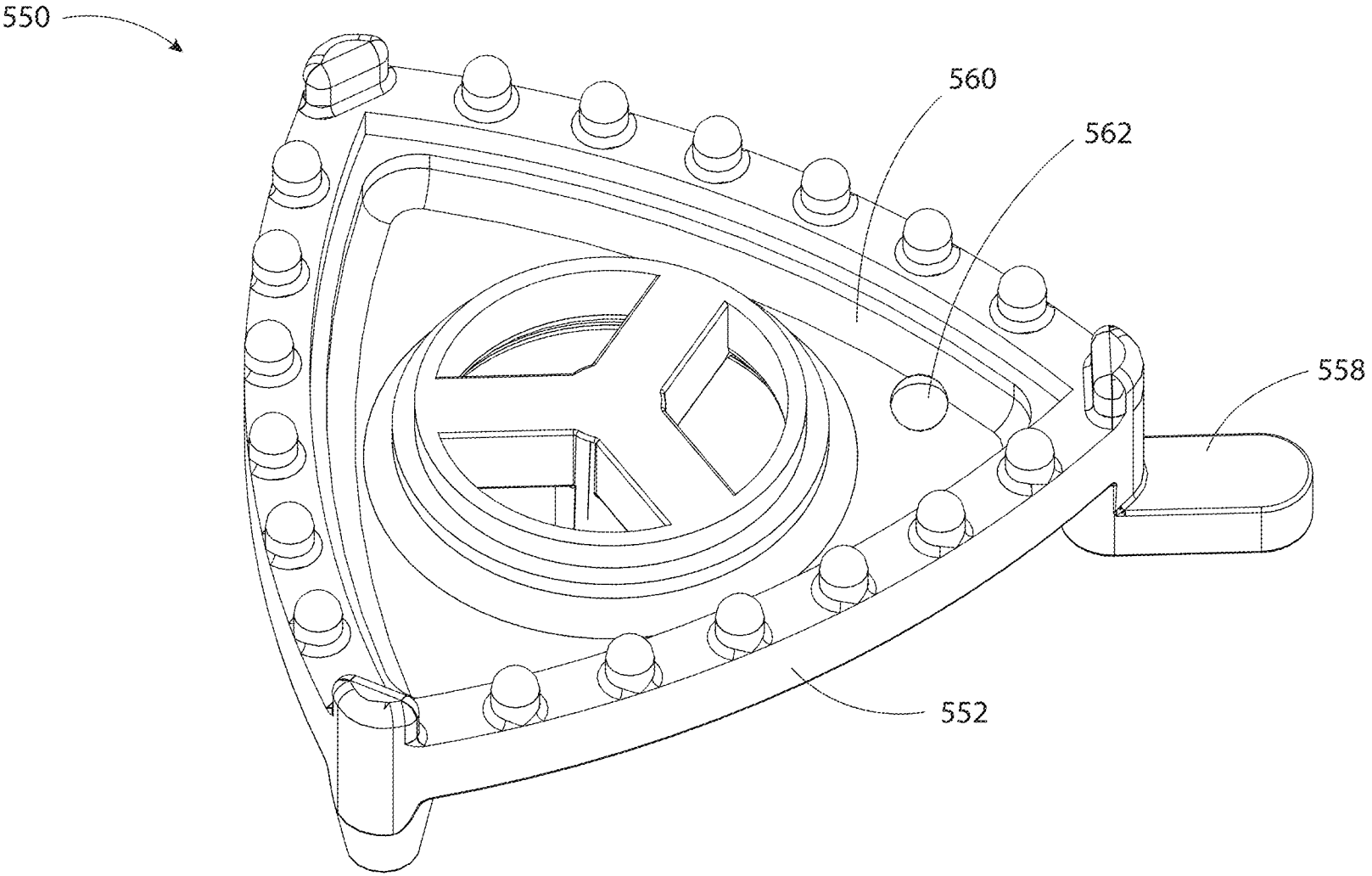
FIG. 5B illustrates a perspective view of the dynamic combined cleaner of FIG. 5A with the cover removed, in accord with aspects of the present disclosure.
Figure 5C:
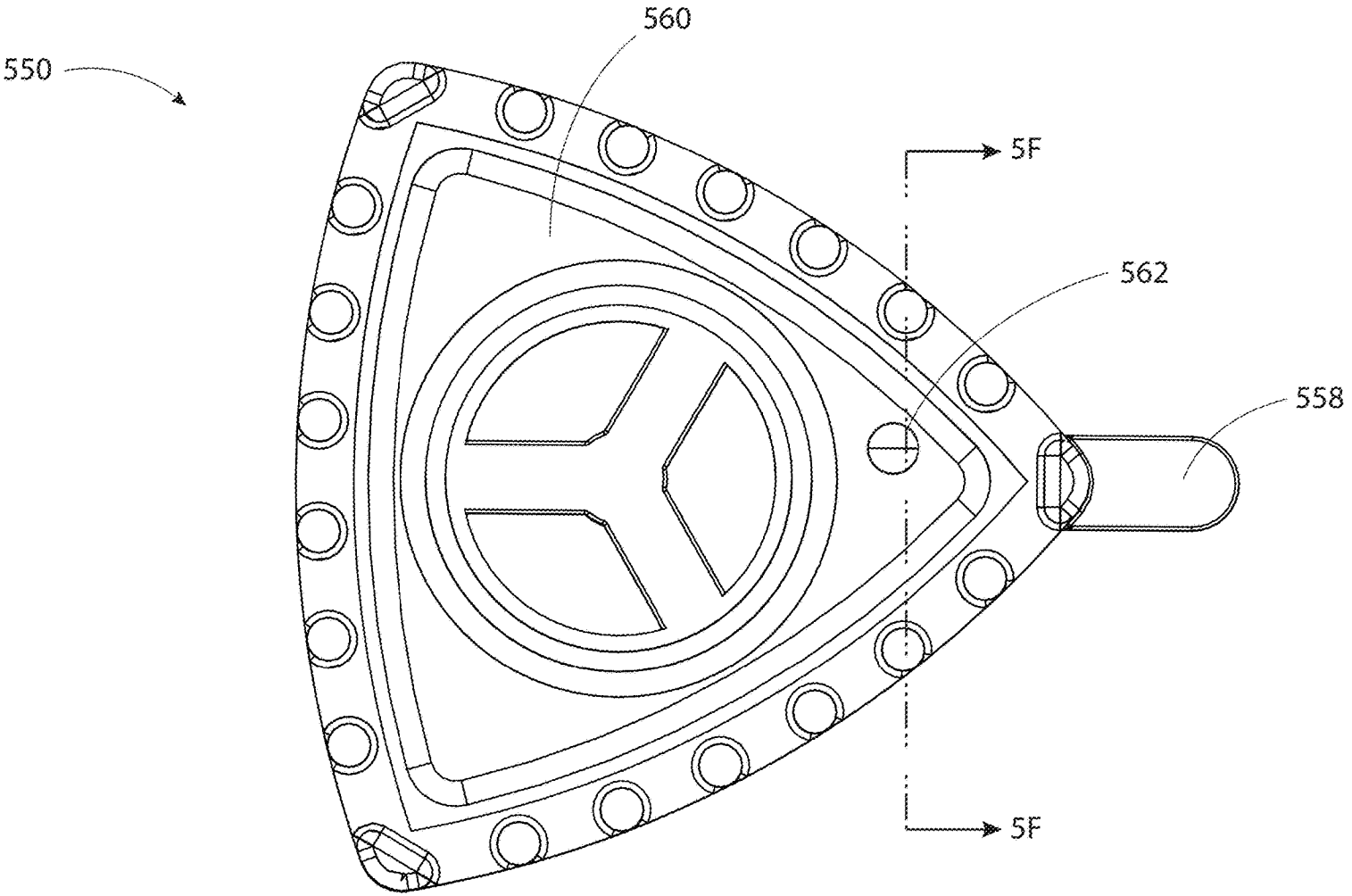
FIG. 5C illustrates a top view of the dynamic combined cleaner of FIG. 5B, in accord with aspects of the present disclosure.
Figure 5D:
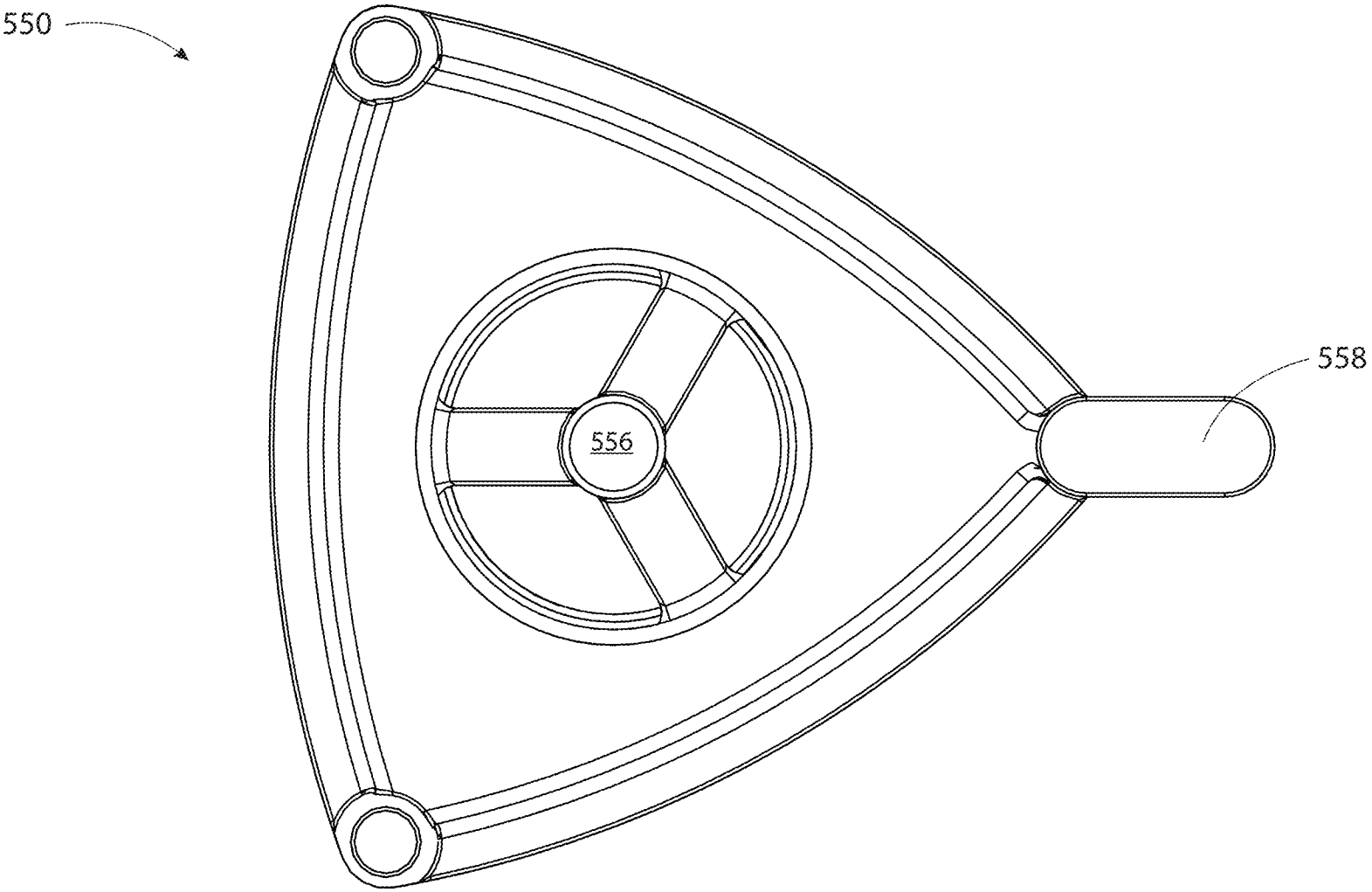
FIG. 5D illustrates a bottom view of the dynamic combined cleaner of FIG. 5A, in accord with aspects of the present disclosure.
Figure 5E:
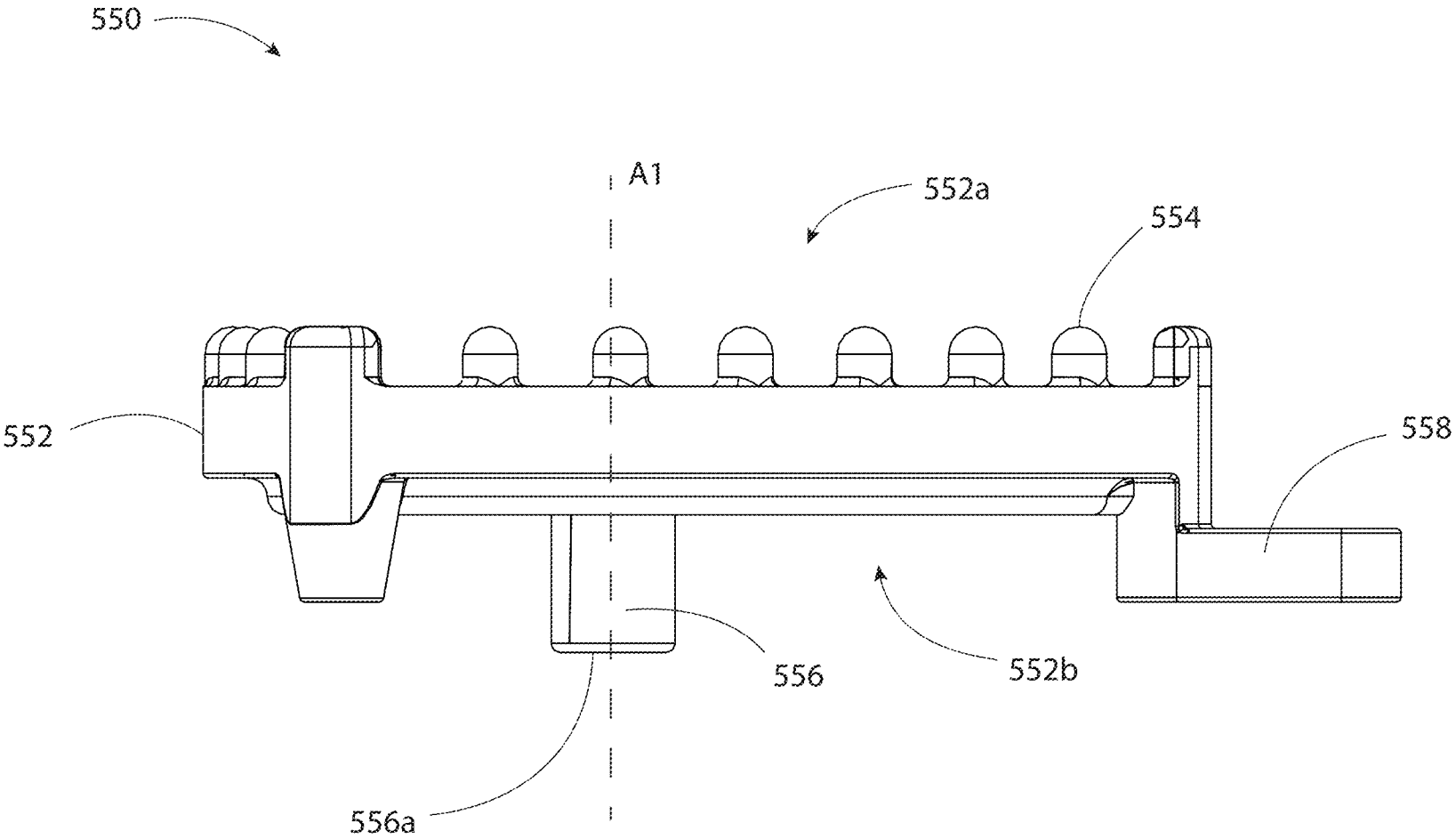
FIG. 5E illustrates a side view of the dynamic combined cleaner of FIG. 5A, in accord with aspects of the present disclosure.
Figure 5F:
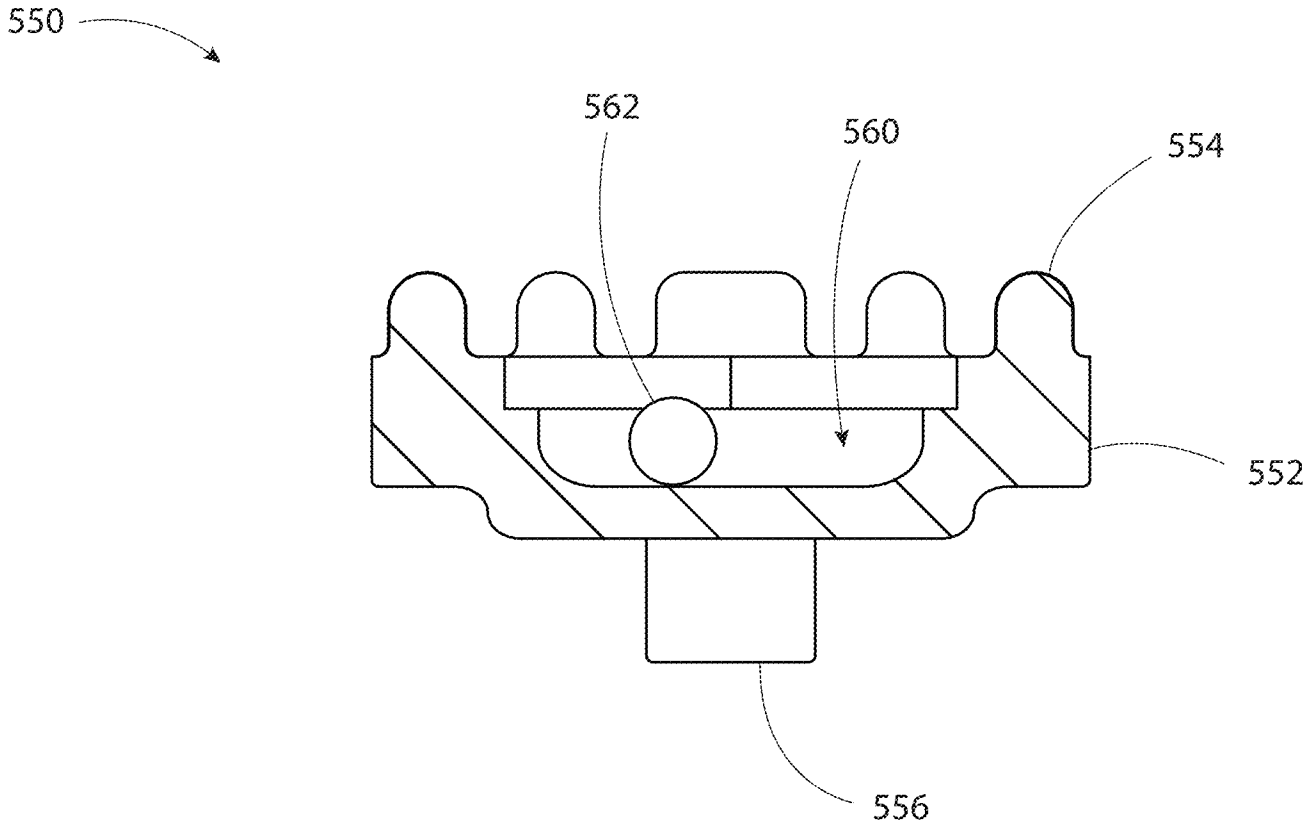
FIG. 5F illustrates a cross-sectional view of the dynamic combined cleaner of FIG. 5A alone the line 5F-5F in FIG. 5C, in accord with aspects of the present disclosure.

FIGS. 5A-5D illustrate a dynamic combined cleaner 550 that solves the above-addressed issues of conventional combined cleaners. Specifically, FIG. 5A illustrates a perspective view of the dynamic combined cleaner 550, in accord with aspects of the present disclosure. FIG. 5B illustrates a perspective view of the dynamic combined cleaner 550 of FIG. 5A with the cover removed, in accord with aspects of the present disclosure. FIG. 5C illustrates a top view of the dynamic combined cleaner 550 of FIG. 5A, in accord with aspects of the present disclosure. FIG. 5D illustrates a bottom view of the dynamic combined cleaner 550 of FIG. 5A, in accord with aspects of the present disclosure. FIG. 5E illustrates a side view of the dynamic combined cleaner 550 of FIG. 5A, in accord with aspects of the present disclosure. FIG. 5F illustrates a cross-sectional view of the dynamic combined cleaner 550 of FIG. 5A along the line 5F-5F in FIG. 5C, in accord with aspects of the present disclosure.

As shown in FIG. 5A, the dynamic combined cleaner 550 includes a body 552, with a one side 552*a* configured to face the sieve cloth within the sieve 300, and one side 552*b* configured to face the bottom sheet 308 of the sieve 300. The side 552*a* of the body 552 includes multiple cleaning heads 554. The side 552*b* of the body 552 includes a projection or foot 556 (FIGS. 5D and E) that extends from the side 552*b*. Extending from side 552*b* of the body 552 also is an arm 558.

As illustrated, the body 552 generally has the shape of a reuleaux triangle. However, the shape of the body 552 can vary without departing from the scope of the present disclosure. For example, the general shape of the body 552 can be circular, triangular, square, rectangular, pentagonal, hexagonal, etc., and various non-uniform shapes.

The projection 556 is configured to rest on the bottom sheet 308 of the sieve 300 and be the furthest distal portion of the cleaner 550 from the side 552*b* of the body 552. The projection 556 also in part determines the height of the dynamic combined cleaner 550. Because the height (e.g., L2 in FIG. 4A) within the sieve 300 between the sieve cloth and the bottom sheet 308 can be larger than the height (e.g., L8 in FIG. 4B) in the sieve 200 depending on the overall height of the sieve 300 versus the sieve 200, the dynamic combined cleaner 550 can be taller in height than a conventional combined cleaner. The additional height allows the dynamic combined cleaner 550 to contact the sieve cloth while resting on the bottom sheet 308. For example, the dynamic combined cleaner 550 can be about 8 mm taller in height to accommodate the height difference. However, in some embodiments, the dynamic combined cleaner 550 can be taller or shorter depending on the dimensions of the sieve in which the dynamic combined cleaner 550 is to be used.

The distal end 556*a* of the projection 556 can be various shapes, such as flat, hemispherical, elliptical, etc. When the distal end 556*a* of the projection 556 is other than flat, the shape can aid the cleaner 550 in being able to tilt so that the cleaning heads 554 can contact the sieve cloth.

The projection 556 can be positioned generally at the center of the body 552. In one embodiment, the projection 556 can define the illustrated axis $A_1$, and the axis $A_1$ can be along the center of gravity of the static portion of the cleaner 550. Alternatively, the center of gravity of the cleaner 550 can be off axis from the axis $A_1$, such as if the arm 558 adds additional weight to the cleaner 550 on one side.

The cleaning heads 554 extend along a perimeter of the body 552. Each cleaning head 554 is configured to contact the sieve cloth above the dynamic combined cleaner 550 during use in the sieve 300 to clean clogs in the sieve cloth. In some embodiments, the cleaning heads 554 can be solid projections, as shown. Alternatively, the cleaning heads can vary, such as having one or more bristles, spikes, etc. that aid in cleaning clogs in the sieve cloth.

The arm 558 projects horizontally from the body 552 of the cleaner 550 to aid in expelling particles that have fallen through the sieve cloth. Although only one arm 558 is shown, in some embodiments, the cleaner 550 can have more than one arm 558, such as one arm 558 on each vertex of the edges of the body 552.

Referring to FIGS. 5B and 5F, the body 552 includes a recess 560. In some embodiments, the recess 560 can extend along substantially the perimeter of the body 552, such as a channel. The recess 560, thus, can be below the cleaning heads 554 or interior to and adjacent the cleaning heads 554. In some embodiments, the recess 560 can span substantially all of the central portion of the body 552 such that the body 552 is substantially hollow with the cover attached.

Within the recess 560 are one or more weight elements 562. The weight elements 562 are enclosed within the recess 560 by a cover 568 (FIG. 5A), which also keeps particles from entering the recess 560. In some embodiments, the weight elements 562 are able to freely move within the recess 560 responsive to inertial movement of the cleaner 550 based on the mechanical movement of the sieve 300 within the sieve stack. In some embodiments, the weight elements 562 can be spherical to aid in the weight elements 562 being able to freely move within the recess 560. However, the weight elements 562 can be any size and shape that is able to freely move within the recess 560 in response to movement of the dynamic combined cleaner 550. In some embodiments, the weight elements 562 can be made of a material that has a greater density than the material the forms the body 552 of the cleaner 550. For example, the weight elements 562 can be ball bearings made of metal and the body 552 can be made of a plastic. The freely moving one or more weight elements 562 create a dynamic unbalancing effect to the cleaner 550 as it is being vibrated about the sieve 300. Not only is the cleaner 550 statically unbalanced, meaning that under static conditions (at rest), the cleaner 550 will tend to tip over and favor one side over other side(s), according to the present disclosure, a dynamic unbalancing element is introduced to move independently relative to movements of the cleaner 550 during vibration of the plansifter. These two combined effects cooperate to produce out-of-phase or poly-phasic movement or kinetic components that allow expanded movements by the cleaner 550 inside the sieve 300, covering maximal area in a consistent way without preferentially favoring too much one spot over others. Thus, the weight elements 562 are a mass in or on the cleaner 550, which can move independently of the cleaner 550 to impart a dynamic or kinetic unbalancing effect as the cleaner 550 undergoes erratic movement within a constrained volume.

Based on the weight elements 562 being able freely move within the recess 560, the weight elements 562 dynamically change the center of gravity of the cleaner 550. The presence of the weight elements 562 causes the center of gravity to never be along the axis $A_1$, which promotes tilting of the cleaner 550 during use and cleaning of the sieve cloth. The weight elements 562 also change the center of gravity to be more sideward, which gives more instability to the cleaner 550.

Although the weight elements 562 are described as being able to freely move within the recess 560, in some embodiments the weight elements 562 can be discrete elements from the body 552 that are statically and fixedly attached to the body 552 and unable to freely move. In such embodiments, the weight elements 562 provide a static unbalancing to the cleaner 550. The weight elements 562 can be attached to the body 552 by being screwed into, adhered to, soldered onto, or otherwise mechanically fastened to the body 552. The weight elements 562 can be attached to the body 552 at locations where the additional weight of the weight elements 562 further adds to the unbalancing of the cleaner 550, which in turn can further aid the cleaner 550 in cleaning and expelling.

The possibility to switch the sieve type between backwire and combined allows for the use of both solutions, or hybrid solutions, for the optimization of a sifting channel. Further, the optional backwire/combined sieve with the dynamic combined cleaner provides reliable and durable cleaning of the sieve cloth, reliable throughput expulsion, and a low probability of choke. Additionally, dynamically changing the center of gravity out of the protrusion or foot axis provides for a more random movement, avoids preferential paths, and leads to an effective tapping against the cloth.

While this disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention(s) as defined by the appended claims.

Each of these embodiments, and obvious variations thereof, is contemplated as falling within the spirit and scope of the claimed invention(s), which are set forth in the following claims. Moreover, the present concepts expressly include any and all combinations and sub-combinations of the preceding elements and aspects.

What is claimed is:

1. A combined cleaner for a sieve within a sieve stack of a plansifter, the cleaner comprising:

a body having a first side configured to face a sieve cloth of the sieve, a second side configured to face a bottom sheet of the sieve, and a channel;

a projection extending from the second side of the body and being configured to rest on the bottom sheet of the sieve;

a plurality of cleaning heads extending from the first side of the body and being configured to contact the sieve cloth during use of the combined cleaner; and one or more weight elements housed within the channel of the body and configured to move within the body independently of movement of the cleaner to thereby dynamically change a center of gravity of the combined cleaner during use within the sieve.

2. The combined cleaner of claim 1, further comprising a cover that encloses the channel within the body.

3. The combined cleaner of claim 1, wherein the channel extends along substantially adjacent to the perimeter of the body.

4. The combined cleaner of claim 1, wherein the one or more weight elements include one or more spheres.

5. The combined cleaner of claim 4, wherein the one or more spheres include one or more ball bearings.

6. The combined cleaner of claim 1, wherein the one or more weight elements are formed of a material that is denser than a material of the body.

7. The combined cleaner of claim 1, wherein the plurality of cleaning elements extends along a perimeter of the body.

8. The combined cleaner of claim 7, wherein the channel is under the plurality of cleaning elements.

9. The combined cleaner of claim 1, wherein a length of the projection defines a first axis, and the one or more weight elements are configured to dynamically shift a center of gravity of the combined cleaner offset from and around the first axis.

10. The combined cleaner of claim 1, wherein the projection is a furthest distal portion of the combined cleaner from the second side of the body.

11. The combined cleaner of claim 1, wherein the body includes at least one expeller arm extending horizontally from the body.

12. A combined cleaner for a sieve within a sieve stack of a plansifter, the cleaner comprising:

a body;

a projection protruding from a first side of the body;

a plurality of cleaning heads extending from a second side of the body, opposite from the first side; and one or more discrete weight elements on the body and configured to provide an unbalancing to the cleaner such that under static conditions the cleaner is unbalanced while at rest on the projection.

13. The combined cleaner of claim 12, wherein a density of the one or more discrete weight elements is greater than densities of the body and the projection.

14. The combined cleaner of claim 12, wherein the one or more discrete weight elements are attached to the body.

15. The combined cleaner of claim 14, wherein the one or more discrete weight elements are mechanically fastened to the body by being screwed into, adhered to, or soldered onto the body.

* * * * *